US010758037B2

(12) United States Patent
van Hooft et al.

(10) Patent No.: US 10,758,037 B2
(45) Date of Patent: Sep. 1, 2020

(54) QUICK ASSEMBLY DESK

(71) Applicant: OAHWIP B.V., Vught (NL)

(72) Inventors: Jan Thomas Lambertus van Hooft, Kerkdriel (NL); Tristan Margareth Raphael Petronella Frencken, 's-Hertogenbosch (NL)

(73) Assignee: OAHWIP B.V., Vught (NL)

( * ) Notice: Subject to any disclaimer, the term of this patent is extended or adjusted under 35 U.S.C. 154(b) by 0 days.

(21) Appl. No.: 16/333,911

(22) PCT Filed: Sep. 16, 2016

(86) PCT No.: PCT/NL2016/050643
§ 371 (c)(1),
(2) Date: Mar. 15, 2019

(87) PCT Pub. No.: WO2018/052282
PCT Pub. Date: Mar. 22, 2018

(65) Prior Publication Data
US 2019/0200752 A1 Jul. 4, 2019

(51) Int. Cl.
*A47B 13/00* (2006.01)
*A47B 13/02* (2006.01)
(Continued)

(52) U.S. Cl.
CPC ..... *A47B 13/003* (2013.01); *A47B 13/021* (2013.01); *A47B 13/06* (2013.01);
(Continued)

(58) Field of Classification Search
CPC ..... A47B 2013/022; A47B 13/003; A47B 13/021; A47B 13/06; A47B 17/00;
(Continued)

(56) References Cited

U.S. PATENT DOCUMENTS 2,973,233 A * 2/1961 McPhee ..... F16B 12/48 248/188
3,063,765 A * 11/1962 Huff ..... A47B 13/021 248/188.8
(Continued)

FOREIGN PATENT DOCUMENTS

DE 8812073 U1 12/1988
DE 4330441 A1 3/1994
(Continued)

OTHER PUBLICATIONS

International Search Report dated Mar. 6, 2017 from PCT/NL2016/050643.

*Primary Examiner* — Jose V Chen
(74) *Attorney, Agent, or Firm* — Adsero IP

(57) ABSTRACT

A desk has legs at or near opposite lateral sides of the desk, feet, each mounted to a lower end of one of the legs and projecting from the leg to which it is mounted in at least a forward or rearward direction, a profile extending from one of the legs to the opposite one of the legs and mounted to upper end portions of the legs; and a desktop panel supported by the profile. The legs are coupled to the profile by twist lock connections. The twist lock connections are each locked or lockable against axial dislodgement by twisting of at least an end part of the leg relative to the profile about a center line of the leg. The profile projects from the legs in the rearward direction more than in the forward direction. A rearwardly projecting portion of the profile supporting the panel from below.

21 Claims, 10 Drawing Sheets

(51) Int. Cl.

| | |
|---|---|
| ***A47B 21/06*** | (2006.01) |
| ***A47B 17/00*** | (2006.01) |
| ***A47B 13/06*** | (2006.01) |
| *A47B 21/02* | (2006.01) |

(52) U.S. Cl.
CPC ..... *A47B 17/00* (2013.01); *A47B 21/06* (2013.01); *A47B 21/02* (2013.01); *A47B 2021/068* (2013.01); *A47B 2200/0012* (2013.01); *A47B 2200/0013* (2013.01); *A47B 2200/0029* (2013.01); *A47B 2200/0082* (2013.01); *A47B 2200/0086* (2013.01)

(58) Field of Classification Search
CPC ... A47B 21/06; A47B 21/02; A47B 2021/068; A47B 2200/0012; A47B 2200/0013; A47B 2200/0029; A47B 2200/0082; A47B 2200/0086
USPC ..... 108/157.1, 156, 153.1, 155, 180; 248/188
See application file for complete search history.

(56) References Cited

U.S. PATENT DOCUMENTS 3,182,846 A * 5/1965 La Kaff ..... A47B 47/03 220/4.28
3,966,340 A 6/1976 Morris
4,725,029 A * 2/1988 Herve ..... B60R 11/00 248/221.12
4,944,235 A * 7/1990 Jahnke ..... A47B 13/003 108/159.11
5,083,512 A 1/1992 Newhouse
5,232,303 A * 8/1993 Rubner ..... A47B 13/021 403/330
5,549,055 A * 8/1996 Kusch ..... A47B 13/003 108/115
5,638,759 A * 6/1997 Klugkist ..... A47B 13/003 108/23
5,934,204 A * 8/1999 Oberle ..... A47B 13/003 108/157.1
6,003,447 A * 12/1999 Cox ..... A47B 3/0815 108/132
6,047,648 A * 4/2000 Alm ..... A47B 13/021 108/157.16
6,146,046 A * 11/2000 Oberle ..... A47B 13/02 403/170
6,283,043 B1 * 9/2001 Stern ..... A47B 13/06 108/50.02
6,415,723 B1 * 7/2002 Kopish ..... A47B 3/0815 108/128
RE38,709 E * 3/2005 Gutgsell ..... H02G 3/0418 108/50.02
6,990,909 B2 * 1/2006 Gosling ..... A47B 83/001 108/50.02
7,631,604 B2 * 12/2009 Huang ..... A47B 3/08 108/115
8,061,279 B2 * 11/2011 Preiss ..... A47B 21/06 108/50.02
8,109,215 B2 * 2/2012 Kitada ..... A47B 21/00 108/50.02
8,584,602 B2 * 11/2013 Isgro ..... B01L 9/02 108/157.18
8,651,441 B2 * 2/2014 Brooke ..... A47B 91/16 248/188.3
8,800,799 B1 * 8/2014 Hawker ..... B65D 7/06 109/51
8,925,469 B2 * 1/2015 Bennie ..... A47B 21/06 108/50.02
9,185,974 B2 11/2015 Martin et al.

FOREIGN PATENT DOCUMENTS

| | | | |
|---|---|---|---|
| DE | 4437392 | A1 | 4/1996 |
| DE | 202004007732 | U1 | 9/2005 |
| DE | 102013003436 | A1 | 8/2014 |
| EP | 0643934 | B1 | 3/1995 |
| EP | 1192874 | A1 | 4/2002 |
| WO | WO 2011/153326 | | 12/2011 |
| WO | WO 2011/153329 | | 12/2011 |
| WO | WO 2011/153332 | | 12/2011 |

* cited by examiner

QUICK ASSEMBLY DESK

RELATED APPLICATIONS

This application is a 35 U.S.C. § 371 national phase application of PCT/NL2016/050643 (WO 2018/052282), filed on Sep. 16, 2016, entitled "Quick Assembly Desk", which is incorporated herein by reference in its entirety.

FIELD AND BACKGROUND OF THE INVENTION

The invention relates to a desk. In the course of furnishing an office with furniture or rearranging furniture in an office space for increasing or decreasing the number of office workers to be accommodated, a substantial amount of time is spent on assembling or disassembling office furniture. This substantially adds to the costs and time required for furnishing an office and is such a burden, that office furniture that is not needed for some time is often stored in assembled condition, which requires a large amount of storage space.

Also desks of office furniture are often of a complicated construction, in particular if the desks are height adjustable and even more so if the desks are easily height adjustable over a large range to the extent that office workers are encouraged to alternatingly work seated and standing at the desk.

SUMMARY OF THE INVENTION

It is an object of the present invention to provide a desk that can be assembled and disassembled easily and quickly.

According to the invention, this object is achieved by providing a desk having:

at least two legs at or near opposite lateral sides of the desk;

at least two feet, each of the feet being mounted to a lower end of one of the legs and projecting from the leg to which it is mounted in at least a forward or rearward direction;

a profile extending from one of the legs to the opposite one of the legs, the profile being mounted to upper end portions of the legs; and a desktop panel supported by the profile;

wherein the legs are coupled to the profile by twist lock connections, the twist lock connections each being locked or lockable against axial dislodgement by twisting of at least an end part of the leg relative to the profile about a center line of the leg.

The invention can also be embodied in desk having:

at least two legs at or near opposite lateral sides of the desk;

at least two feet each mounted to a lower end of one of the legs and projecting from the leg to which it is mounted in at least a forward or rearward direction;

a profile extending from one of the legs to the opposite one of the legs, the profile being mounted to upper end portions of the legs; and a desktop panel supported by the profile;

wherein the desktop panel projects from the legs in the rearward direction more than in the forward direction and has at least one opening between forward and rearward facing edge portions of the panel bounding the opening;

wherein the profile has an upwardly projecting portion projecting upwardly relative to laterally adjacent portions of the profile and projecting upwardly through the opening in the panel;

wherein the upwardly projecting portion has a forwardly projecting hooking flange engaging the rearwardly facing edge portion from above; and wherein the profile projects from the legs in the rearward direction more than in the forward direction, a rearwardly projecting portion of the profile supporting the panel from below.

Such a desk is of a simple and versatile construction and allows desktop panels to be assembled with a frame structure in a particularly simple manner.

Particular elaborations and embodiments of the invention are set forth in the dependent claims. Features of desks as described above and of embodiments thereof can also be combined advantageously to provide a particularly versatile desk that can be assembled and disassembled particularly easily.

Further features, effects and details of the invention appear from the detailed description and the drawings.

DETAILED DESCRIPTION

Figure 1:
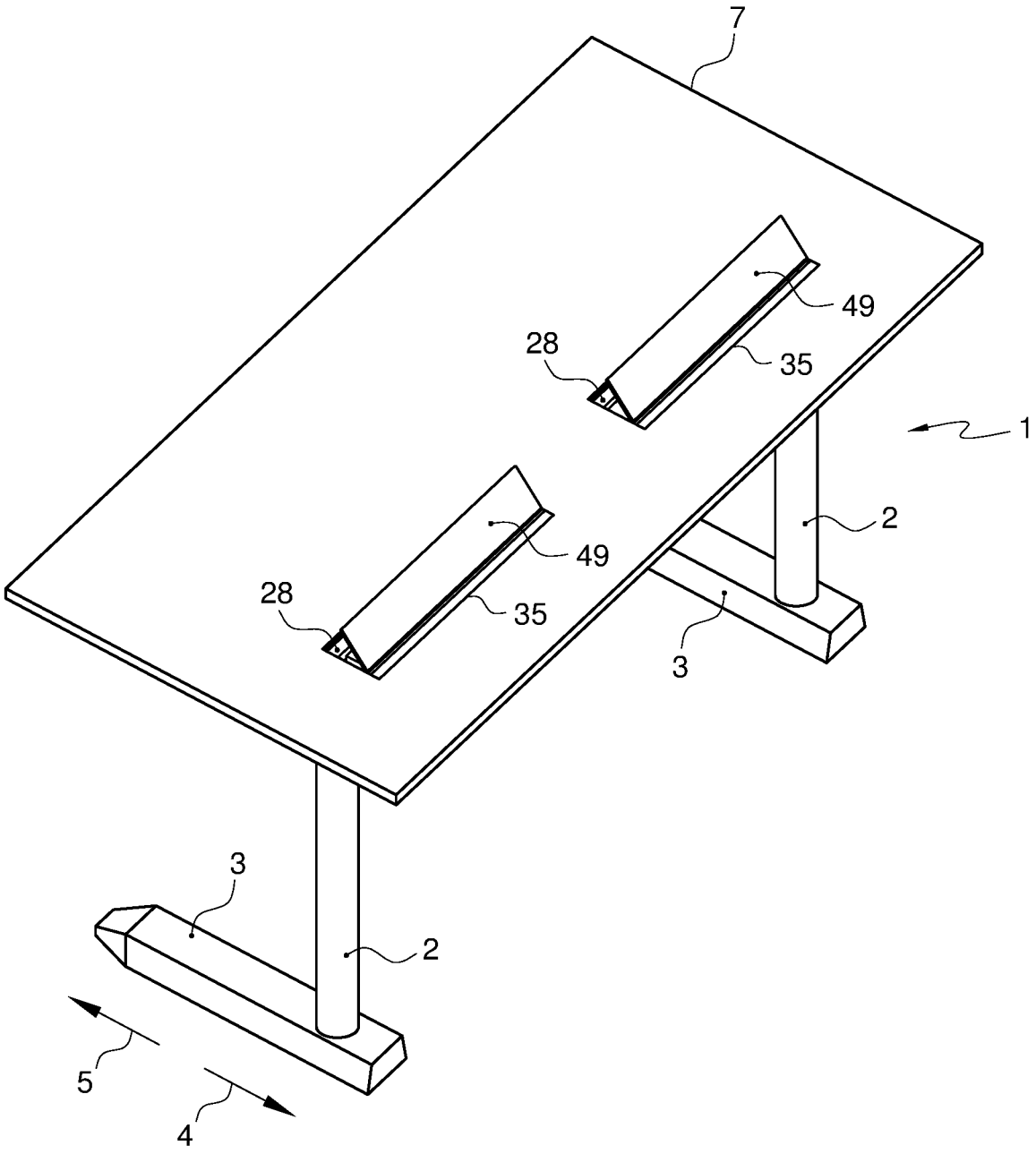
FIG. 1 is a perspective view of an example of a desk according to the invention.

The invention is described with reference to an example of a desk according to the invention shown in the drawings. Discussed effects of features are also applicable to other embodiments of the invention than the present example, which include the discussed features.

In the drawings, a desk 1 is shown that has a two legs 2 at or near opposite lateral sides of the desk 1. A foot 3 is mounted to a lower end of each of the legs 2 and projects from the leg 2 to which it is mounted in a forward direction 4 and a rearward direction 5. Depending on the position of the legs 3 in forward direction 4 and rearward direction 5, the feet 3 may also project from the legs 2 in the forward direction 4 or the rearward direction 5 only. The feet 3 are of such a length, e.g. at least 45 cm and more preferably at least 50 cm, that the desk 1 is sufficiently supported to avoid inadvertent forward and backward tilting in normal use.

The number of legs may also be larger than two, for instance if the desk is of a large length. Preferably, the legs of the desk are arranged in one single row to leave space under the desk relatively free and uncluttered.

A profile 6 extends from one of the legs 3 to the opposite one of the legs 3 and is mounted to upper end portions of the legs 3. A desktop panel 7 is supported by the profile 6. Thus, the feet 3 support the legs 2, the legs 2 support the profile 6 and the profile 6 supports the desktop panel 7.

The legs 2 are coupled to the profile 6 by twist lock connections 8. The twist lock connections 8 are each locked or lockable against axial dislodgement by twisting of at least an end part of the leg 2 relative to the profile 6 about a center line of the leg 2. In the present example, the twist locks 8 are in a form similar to bayonet mounts, but with locking latches 9 instead of pins. However, the twist locks may also be in other forms, such as in the form of classic bayonet mounts or in the form of screw connections. More in particular, the twist lock allows parts to be mounted to each other to be mated in an axial direction, in a relative position that allows one or more protrusions of one part to pass through corresponding recesses of an opening in the other part, followed by a locking movement in rotational sense about an axis of rotation is the axial direction, which locking movement may involve a slight further or backward axial movement, for instance due to movement of one of locking parts along a wedging surface of the other part to pre tension the locked parts against each other, thereby eliminating play. After the locking rotation, the protrusions of one part are axially located behind lands between the recesses in the opening so that the parts are locked against axial dislodgement.

A particularly stable locking is obtained if the twist lock includes one part with locking protrusions projecting in opposite directions and recesses in the other part projecting in corresponding directions and locking rotation is to a locked orientation about perpendicular to the orientation at axial insertion. However, also other corresponding numbers of protrusions and recesses may be combined with other angles of rotation for locking, e.g. three protrusions and corresponding recesses uniformly distributed in circumferential sense with an angle of rotation of about 60° or, more in general, n protrusions and corresponding recesses uniformly distributed in circumferential sense with an angle of rotation of about 360°/2n.

Because the legs 2 are mounted to the profile 6 by twist lock connections 8, the legs 2 can be mounted and dismounted very quickly without use of tools or fasteners. This allows the desk 1 to be assembled and disassembled very quickly.

The legs 2 are also each coupled to one of the feet 3 by a twist lock connection 10. Also these lower twist lock connections 9 are each locked or lockable against axial dislodgement of the leg 2 relative to the foot 3 coupled or to be coupled thereby by twisting of the leg 2 relative to the foot 3 coupled or to be coupled thereby about a center line of the leg 2. Thus also the connections of the legs 2 to the feet 3 can be made very quickly and without tools or fasteners.

When assembling a desk, the legs 2 may for instance first be inserted through openings 11, 12 in the profile 6 from a bottom side of the profile 6 in an upside down position and twisted to be locked completely or provisionally. Then, the feet 3 may be attached to the upwardly pointing lower ends of the leg 2 by inserting these ends into openings 13, 14 in the feet 3 and twisting of the feet 3 relative to the legs 2.

For each of the legs 2, twist lock members of the twist lock connections 10 of that leg 2 to one of the feet 3 and of the twist lock connection 8 of that leg 2 to the profile 6 are rotationally fixed relative to a central portion of the leg 2. This allows exerting a substantial torque onto both the upper twist locks 8 and the lower twist locks 10 using the respective foot 3 as a lever. Because at each side of the desk 1, the upper twist locks 8 and the lower twist locks 10 are both arranged to be locked by exerting a right hand torque, exertion of a torque onto the foot 3 causing the coupled leg 2 to be entrained may also cause the locking of the upper twist lock 8 to be finalized. This can also be achieved if the twist locks on both sides or on one side are both arranged to be locked by exerting a left hand torque.

Each of the twist lock connections 8, 10 includes an abutment 15, 16 determining an angular position of the leg 2 about its center line relative to the profile 6 or the foot 3 coupled thereby. Thus, it is ensured that the feet 3 are in a predetermined orientation relative to the desktop panel 7 and relative to each other when the twist locks 8, 10 are locked.

The twist lock connections 8, 10 also each include a locking member 17, 18 for locking the leg 2 in the angular position of the leg 2 about its center line when the twist locks 8, 10 are locked. Thus, the feet 3 are prevented from inadvertent rotation and associated unlocking of one or both of the twist locks 8, 10 is also prevented.

The abutments 15 on the profile 6 are formed by cut-off ends of ribs 19 of the profile 6 and therefore obtained in a particularly efficient manner. Also, the cut-off ribs 19 constitute and additional reinforcement and stiffening against deformation of the profile 6 directly adjacent the position where forces are transferred to the legs 2 and in particular the latches 9 of the upper twist locks 8.

Figure 6:
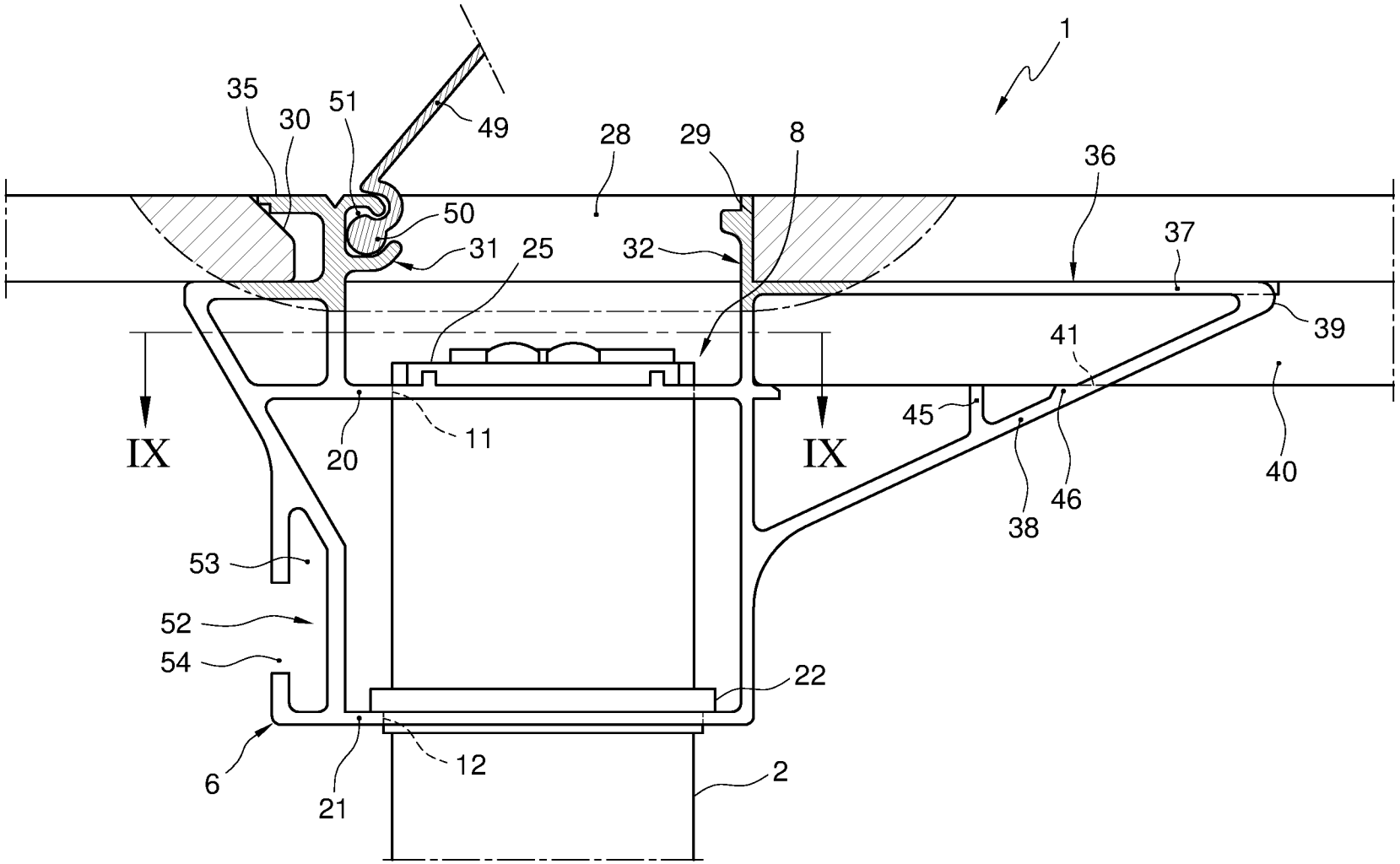
FIG. 6 is an enlarged side view of a portion of the desk shown in FIGS. 1 5.
Figure 7:
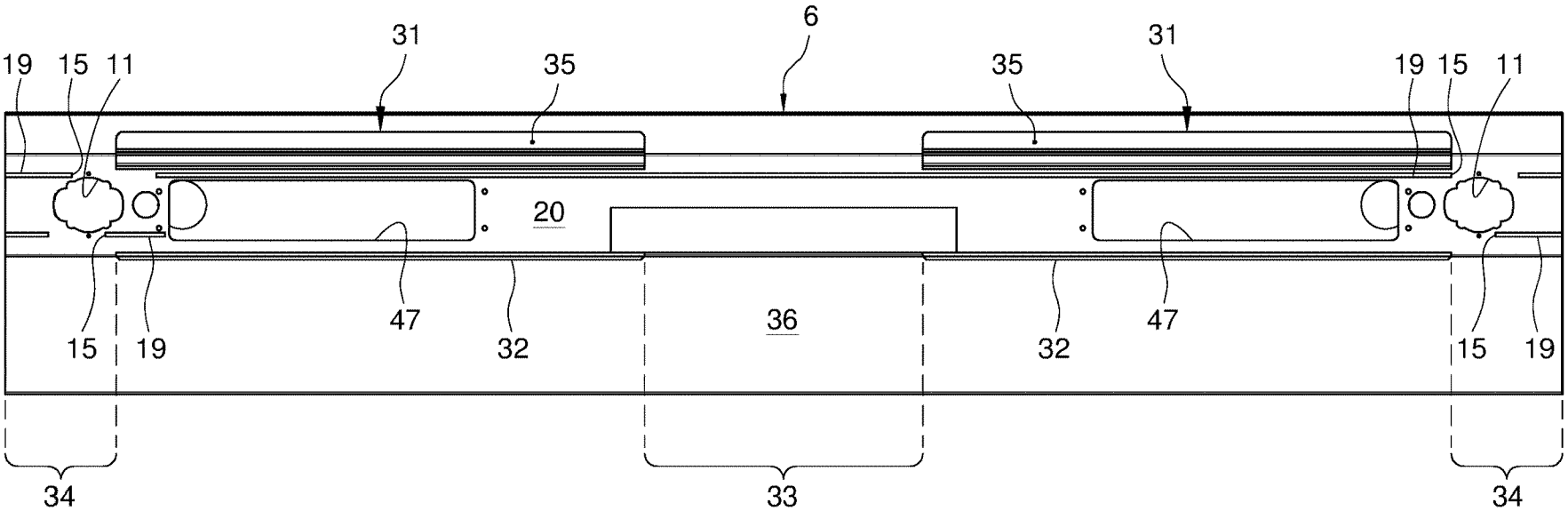
FIG. 7 is a top view of a profile of the desk shown in FIGS. 1-6.
Figure 8:
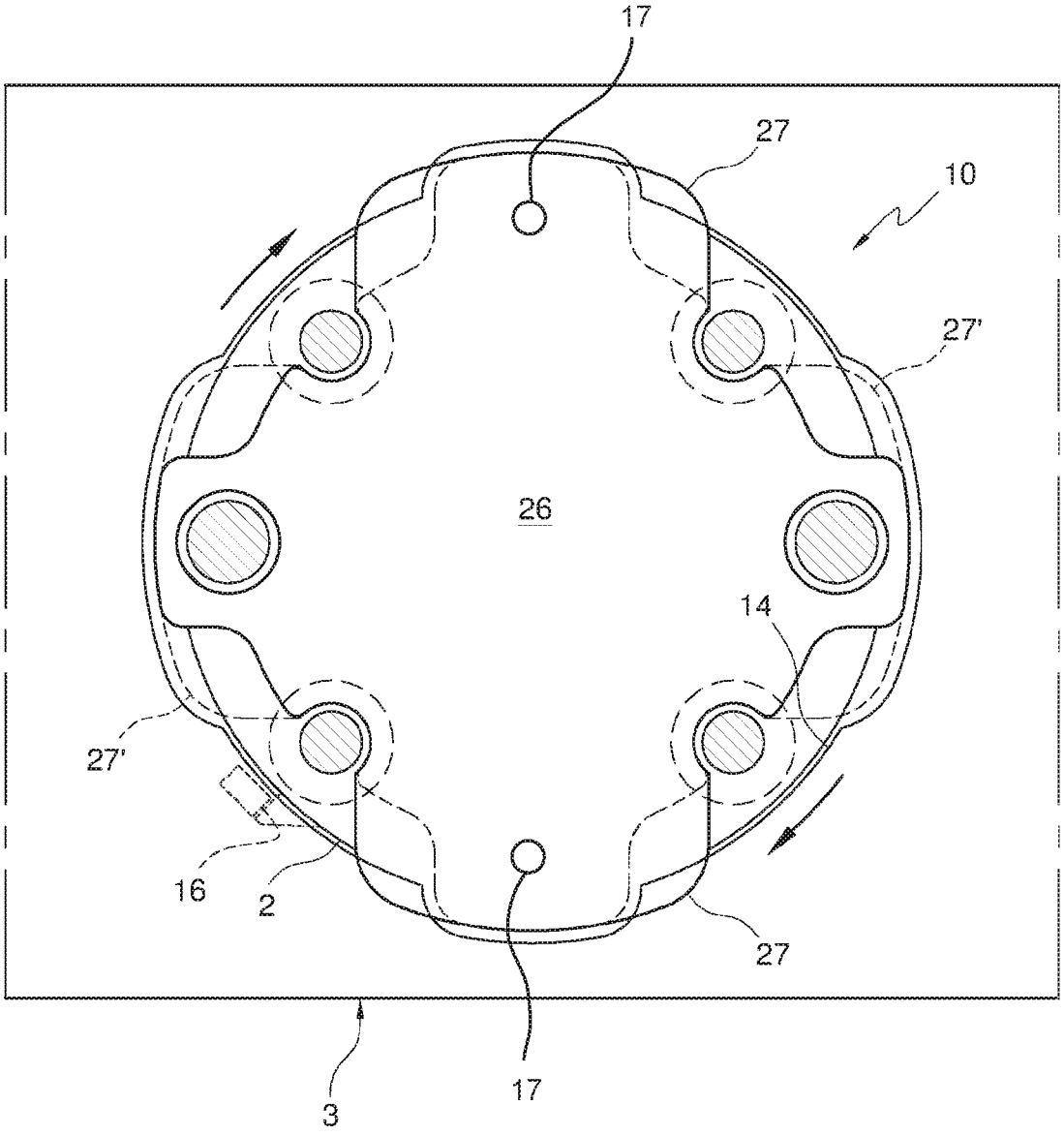
FIG. 8 is a bottom view of a portion of a foot of the desk shown in FIGS. 1 7.
Figure 9:
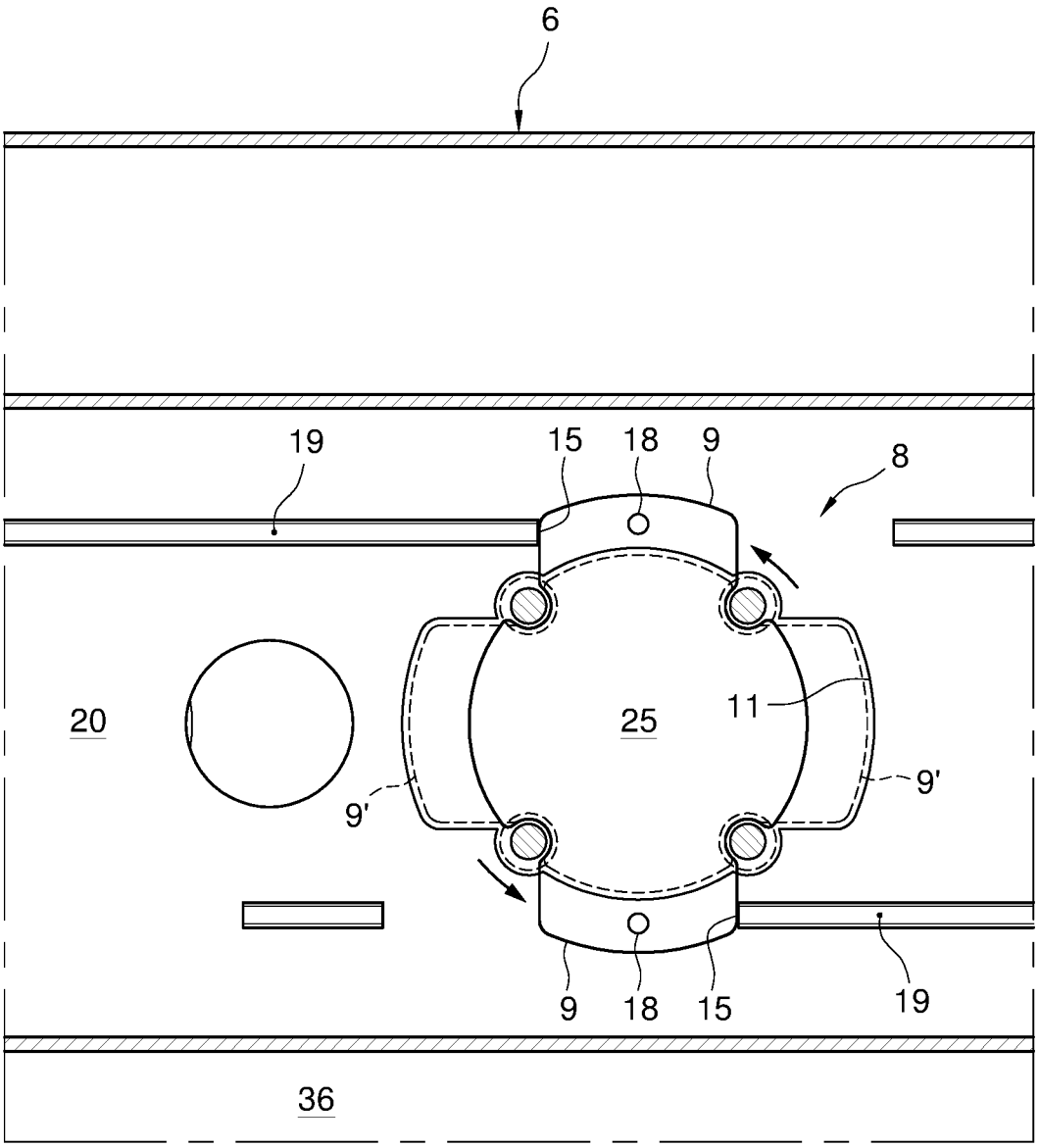
FIG. 9 is a cross-sectional view along the line IX-IX in FIG. 6.

As is best seen in FIG. 6, the profile 6 has an upper wall 20 and a lower wall 21 vertically spaced from the upper wall 20. The legs 2 each extend through openings 11, 12 in the upper and lower walls 20, 21 and fitting in the openings 11, 12 with a sliding fit. Because the openings 11, 12 are spaced apart in longitudinal direction of the legs 2, a connection with a particularly high resistance against a tilting moment transferred from the profile 6 to the legs 2 is obtained.

The legs 2 are each equipped with a fitting ring 22 that provide the sliding fit in the lower openings 12 of the upper twist lock connections 8. The lower openings 12 of the upper twist lock connections 8 have a larger diameter than the upper openings 11 of the upper twist lock connections 8, so that the latches 9 that are to engage behind edge areas of the upper openings 11 can pass through the lower openings 12 without requiring recesses in the lower openings for allowing the latches 9 to pass through.

The feet 3 each have an upper wall 23 and a lower wall 24 vertically spaced from the upper wall 23. The leg 2 coupled to the feet 3 each extend through openings 13, 14 in the upper and lower walls 23, 24 and fitting in the openings with a sliding fit. Because the openings 13, 14 are spaced apart in longitudinal direction of the legs 2, a connection with a particularly high resistance against a tilting moment transferred from the legs 2 to the feet 3 is obtained.

The sliding fit preferably has no play or a play of less than 0.1 mm and more preferably 0.05 mm. Mounting with a slight pre-tension still allowing manual insertion is also possible.

For providing the twist lock connections 8, 10 the legs 2 are each equipped with locking plates 25, 26 mounted to ends of the legs 2 (see FIGS. 5, 6, 8 and 9). Thus, the latches 9, 27 in of the upper and lower twist lock connections 8, 10 are provided in particularly efficient manner. Moreover, the latches 9, 27 can easily be mounted to standard legs 2. This is particularly advantageous if height adjustable legs are to be provided, because stock items can be used and no specially designed and manufactured legs are required. The positions of latches 9', 27' when the locking plates are in unlocked positions are shown in dotted lines.

The locking plates 9, 27 are stamped from metal plate, grated edges of the locking plates 9, 27 being on a side of the plate facing away from the leg 2. The side of stamped plate facing away from the grate typically is slightly chamfered, so that the sides facing the legs 2 smoothly engage when the twist locks 8, 10 are locked.

Figure 2:
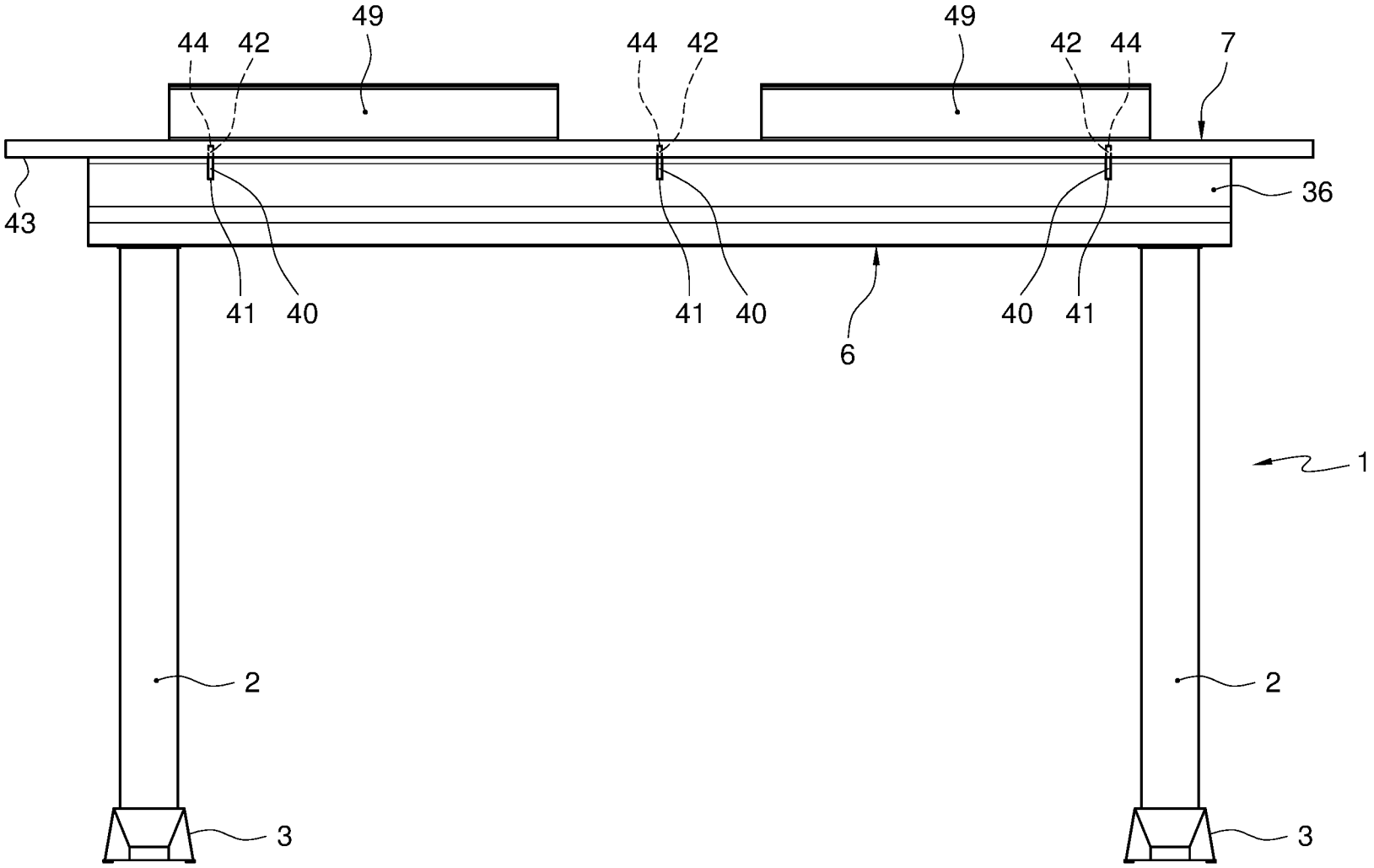
FIG. 2 is a rear view of the desk shown in FIG. 1.
Figure 3:
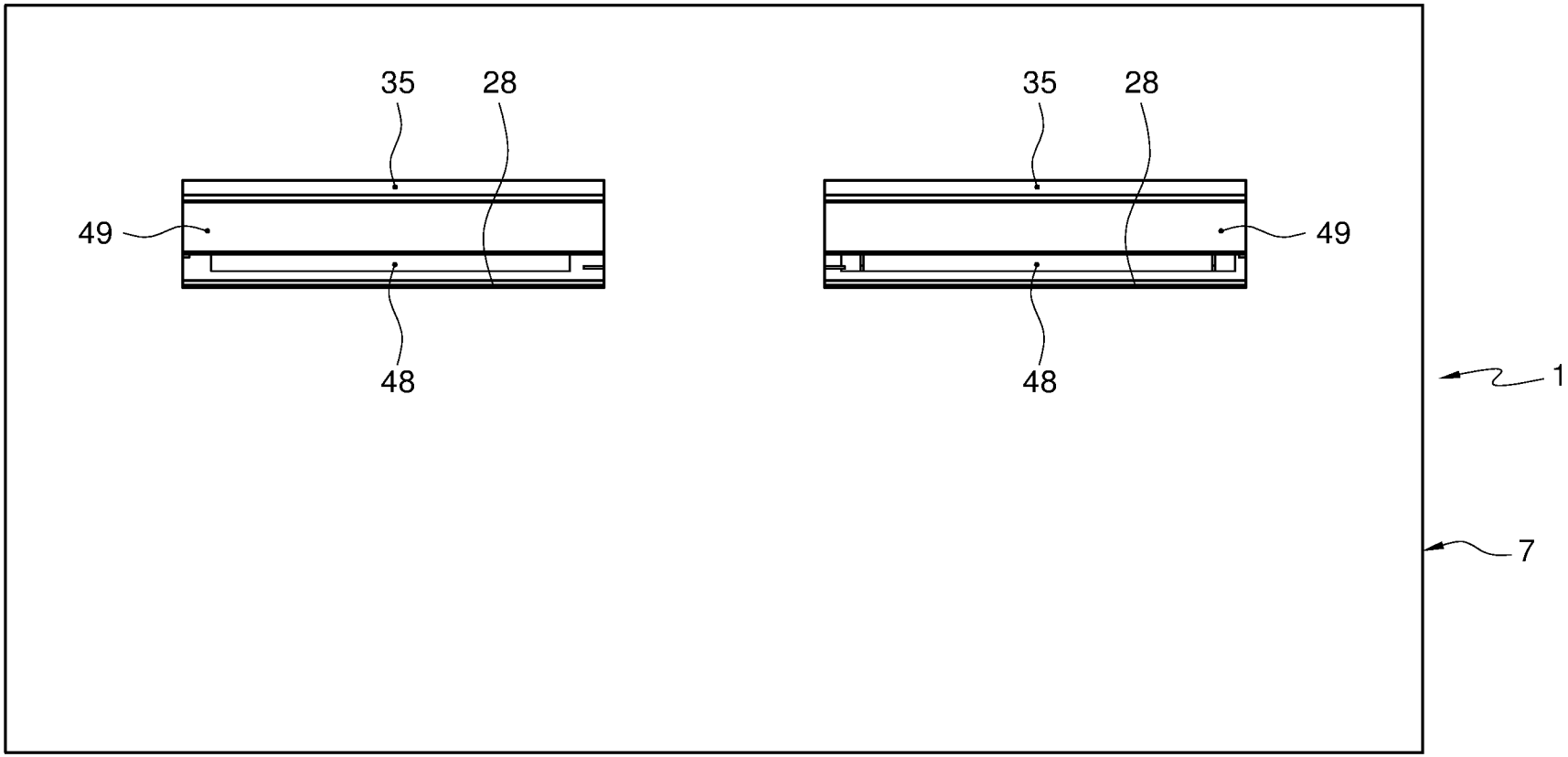
FIG. 3 is a top view of the desk shown in FIGS. 1 and 2.
Figure 4:
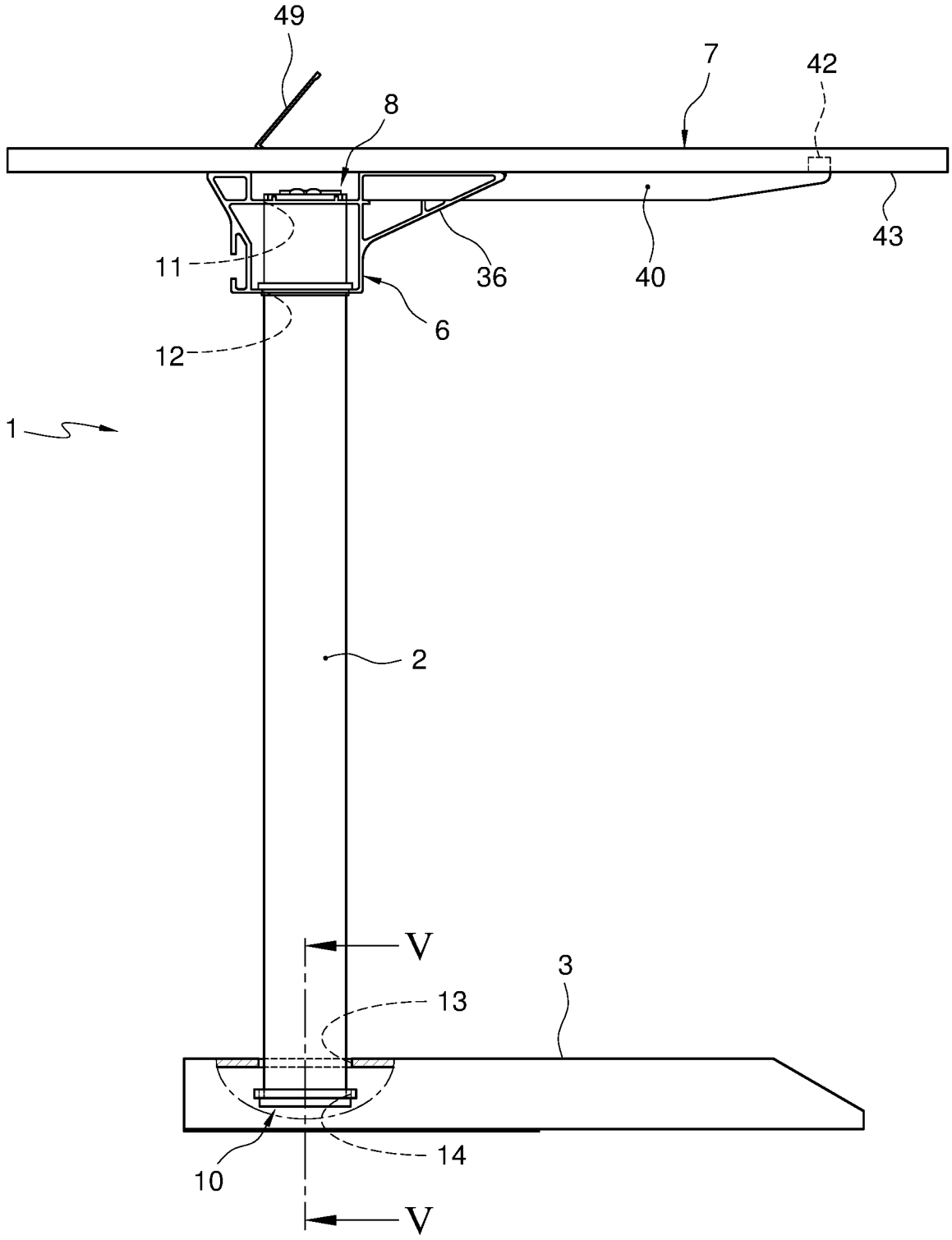
FIG. 4 is a side view of the desk shown in FIGS. 1-3.
Figure 5:
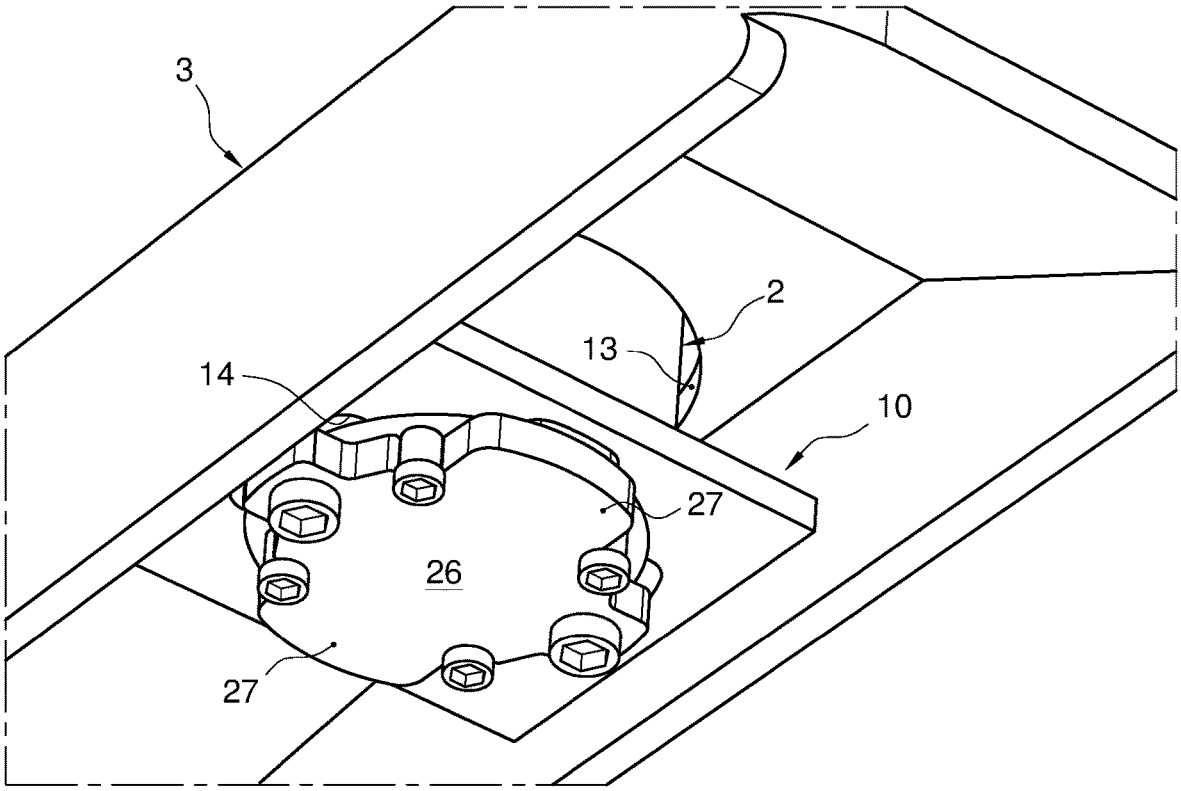
FIG. 5 is a cross-sectional view along the line V-V in FIG. 4

As is best seen in FIGS. 2 and 4, each leg 2 has a leg part 58 defining a cylindrical circumference engaging the profile 6 mounted to that leg 2. This leg 58 part is mounted to an adjacent, more central part 59 of the leg 2. Using such leg parts engaging the profile 6 of the foot 3 mounted to the leg allows using various types of central parts for the legs 2, which do not have to match particular tolerances or have defined shapes for co-operation with the other part at the twist-lock connection 8 or 10. This is of particular advantage if the leg is height adjustable, since it allows the use of standard designs of various manufacturers for the central part, or if a central part with a particular design is desired, because the requirements that the end meet the requirements of the twist lock connections is thus circumvented.

The profile has a central chamber 60 (see FIG. 6) that is shaped and dimensioned so that the legs 2 in dismounted condition can be inserted therein. This allows a kit of parts for assembling a desk, except for the desktop panel 7, to be stored and shipped in a particularly compact manner. The desktop panels 7 are preferably manufactured at more distributed locations than the legs and the profile and can be made in a wide variety of designs and shapes in accordance with customer orders.

The desktop panel 7 projects from the legs 2 in the rearward direction 5 more than in the forward direction 4 and has openings 28 between forward and rearward facing edge portions 29, 30 of the desktop panel 7 bounding the openings 28.

The profile 6, which is preferably an extruded aluminum alloy profile, has upwardly projecting portions 31, 32 projecting upwardly relative to laterally adjacent portions 33, 34 of the profile 6 and each projecting upwardly through one of the openings 28 in the panel 7. One of the upwardly projecting portions 31 each have a forwardly projecting hooking flange 35 engaging the rearwardly facing edge portion 30 of the panel 7 from above. The profile 7 projects from the legs 2 in the rearward direction 5 more than in the forward direction 4 and a rearwardly projecting portion 36 of the profile 6 supports the panel 7 from below.

The profile 6 predominantly projecting rearwardly from the legs 2 thus effectively supports the panel 7 predominantly projecting rearwardly from the legs 2 against backward tilting even if a substantial backward tilting moment is exerted on the desktop panel 7, for instance by a person sitting or standing behind (i.e. at the rear side of) the desk 1.

The support is particularly effective if, as in the present example, the rearwardly projecting portion 36 of the profile 6 extends along substantially the entire length of the profile 6 in the lateral direction.

The rearwardly projecting portion 36 of the profile 6 has upper and lower wall portions 37, 38 converging towards a rearward end 39 of the profile 6, so that the rearwardly projecting portion 36 of the profile 6 has a particularly high bending stiffness against downward tilting moments.

Furthermore, support arms 40 of flat material extending in an orientation along a vertical plane are provided to further support the desktop panel 7 against bending down in a backward area due to a load exerted thereon. The support arms extend through slits 41 from inside the profile 6. The slits 41 resist buckling or bending sideways out of the vertical orientation of the flat support arms 40, so that the support arms can resist large vertical loads.

The support arms 40 each have an upwardly projecting portion 42 and the panel 7 has a downwardly facing face 43 having slits 44. The upwardly projecting portions 42 of the support arm 40 project into the slits 44 with a fit preventing tilting of the flat material of the arms 40 out of the orientation along the vertical plane. The slits 44 in the panel provide further resistance against buckling or bending sideways out of the vertical orientation of the flat support arms 40, so that the support arms 40 can resist particularly large vertical loads.

The support arms 40 are received between the upper and lower wall portions 37, 38 and rests against ribs 45, 46 on the lower wall portion 38. Thus, the lower wall portion 38 is particularly stiff where loads are transferred from the arms 40 to the lower wall portion 38. Also, the loads are distributed, because the support arms 40 each rest against more than one rib 45, 46.

Between portions of the upwardly projecting portion 31, the profile 6 is provided with an opening 28 accommodating a power plug socket 48. Thus, a power plug socket 48 is accommodated in the opening 28 and easily accessible from above. The profile also serves for accommodating the power plug socket and holding it in place.

The desk 1 further has lids 49 that are pivotable between a closed position at least partially closing off the opening 28 and an open position allowing at least more access to the opening 28 than in the closed position. The lids 49 have thickened portions 50 pivotably received in a slot 51 in the profile 6 having an open side narrower than the thickened portions 50. Thus, the profile 6 further serves as a hinge part for the lids 49.

Figure 10:
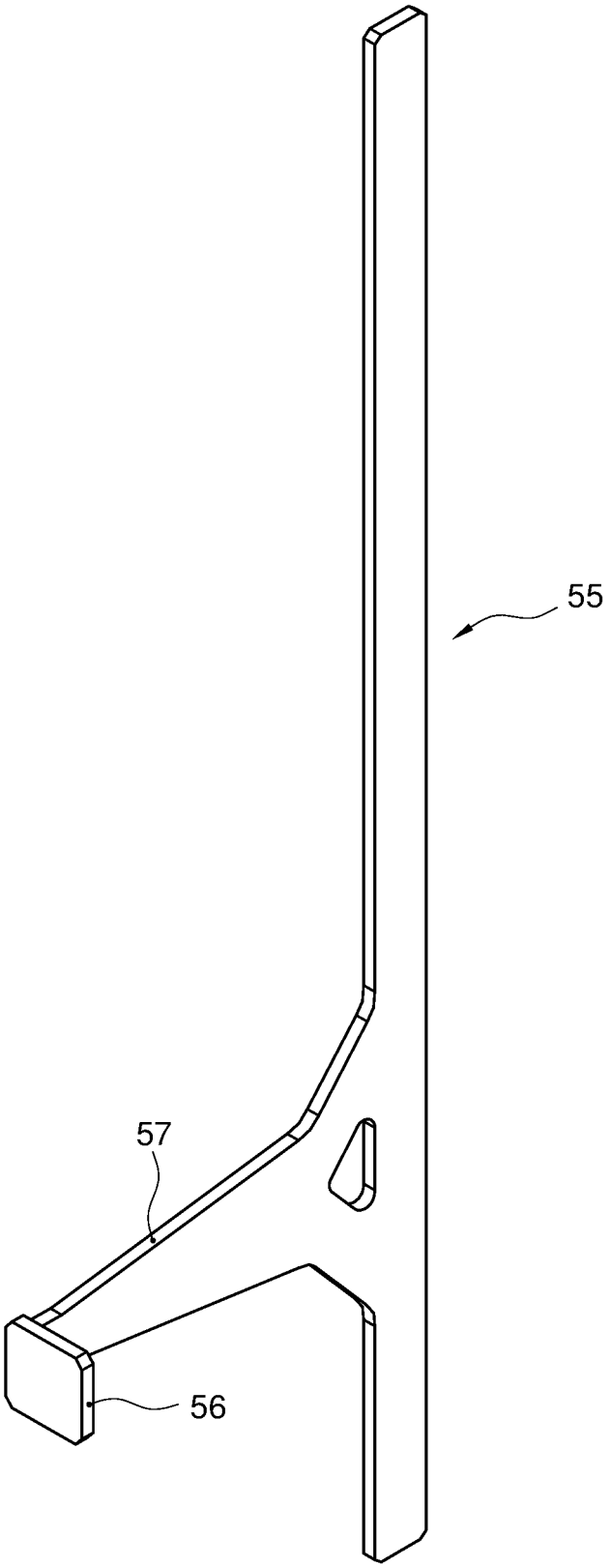
FIG. 10 is a perspective view of a carrier for mounting an accessory to a desk according to FIGS. 1-9.

The profile 6 further has a slot 52 bounding a chamber 53 and having a forwardly facing open side 54. In vertical direction, the open side 54 is narrower than the chamber 53. This slot 52 can be used for fixing accessory carriers such as the screen carrier 55 shown in FIG. 10 or a display screen carrier to the profile 6. Thus, the profile 6 can also serve as a mounting rail for fixing accessory carriers to the desk 1. The carrier 55 has a carrier plate 56 of a width (in vertical direction) that is larger than the distance from the bottom of the chamber 53 to the upper side of the open side 54, so that the carrier plate 56 can be received in the chamber 53. A carrier arm 57 projects form the carrier plate 56 in such a position that it projects through the open side 54 of the slot 53 if the carrier plate 56 is received in the chamber 53 with the carrier arm 57 projecting forward.

As is best seen in FIG. 6, an upper portion of the rearwardly facing edge portions 30 of the openings 28 is chamfered so as to be leaning obliquely forwardly. This allows these edge portions 30 to be wedged under the forwardly projecting ribs 35 of the profile 6 if the desktop panel 7 is mounted by tilting it from a position in which the rear end is higher than the front end while rear upwardly projecting portions 32 of the profile 6 engage the forward facing edge portions 29 of the openings 28. Preferably, the opening 28 is dimensioned such that the rearwardly facing edge portions 30 of the openings 28 are slightly deformed so that the desktop panel is snugly clamped under the forwardly projecting ribs 35 of the profile 6 if the desktop panel 7 is mounted by tilting it from a position in which the rear end is higher than the front end while rear upwardly projecting portions 32 of the profile 6 engage the forward facing edge portions 29 of the openings 28.

The invention claimed is:

1. A desk comprising:

at least two legs at or near opposite lateral sides of the desk;

at least two feet, each of said feet being mounted to a lower end of one of the legs and projecting from the leg to which it is mounted in at least a forward or rearward direction;

a profile extending from one of said legs to the opposite one of said legs, said profile being mounted to upper end portions of the legs; and a desktop panel supported by said profile;

wherein said legs are coupled to said profile by twist lock connections, said twist lock connections each being configured to be locked against axial dislodgement by twisting of at least an end part of the leg relative to the profile about a center line of the leg; and wherein said profile has an upper wall and a lower wall vertically spaced from said upper wall, the legs each extending through openings in said upper and lower walls and fitting in said openings with a sliding fit.

2. The desk according to claim 1, wherein said legs are each coupled to one of said feet by a twist lock connection said twist lock connections each being configured to be locked against axial dislodgement of the leg relative to the foot coupled thereby by twisting of the leg relative to the foot coupled thereby about a center line of the leg.

3. The desk according to claim 2, wherein, for each of said legs, twist lock members of said twist lock connections of said leg to one of said feet and of said twist lock connection of said leg to said profile are rotationally fixed relative to a central portion of said leg.

4. The desk according to claim 1, wherein each of said twist lock connections includes an abutment determining an angular position of the leg about its center line relative to the profile or foot coupled thereby.

5. The desk according to claim 4, wherein each of said twist lock connections includes a locking member for locking the leg in said angular position of the leg about its center line.

6. The desk according to claim 4, wherein the abutments on the profile are formed by cut-off ends of ribs of said profile.

7. The desk according to claim 1, wherein said feet each have an upper wall and a lower wall vertically spaced from said upper wall, the leg coupled to said feet each extending through openings in said upper and lower walls and fitting in said openings with a sliding fit.

8. The desk according to claim 1, wherein the sliding fit has no play or a play of less than 0.1 mm.

9. The desk according to claim 1, wherein the legs are each equipped with at least one locking plate mounted to an end of the leg.

10. The desk according to claim 9, wherein the locking plate is stamped from metal plate, grated edges of the plate being on a side of the plate facing away from the leg.

11. The desk according to claim 1, wherein each leg has a leg part defining a cylindrical circumference engaging the profile or the foot mounted to said leg, said leg part being mounted to an adjacent, more central part of the leg.

12. A desk comprising:

at least two legs at or near opposite lateral sides of the desk;

at least two feet each mounted to a lower end of one of the legs and projecting from the leg to which it is mounted in at least a forward or rearward direction;

a profile extending from one of said legs to the opposite one of said legs, said profile being mounted to upper end portions of the legs; and a desktop panel supported by said profile;

wherein said desktop panel projects from said legs in the rearward direction more than in the forward direction and has at least one opening between forward and rearward facing edge portions of said panel bounding said opening;

wherein the profile has an upwardly projecting portion projecting upwardly relative to laterally adjacent portions of said profile and projecting upwardly through said opening in said panel;

wherein said upwardly projecting portion has a forwardly projecting hooking flange engaging said rearwardly facing edge portion of the panel from above; and wherein said profile projects from said legs in the rearward direction more than in the forward direction, a rearwardly projecting portion of said profile supporting said panel from below.

13. The desk according to claim 12, wherein said rearwardly projecting portion of said profile extends along substantially an entire length of said profile in said lateral direction.

14. The desk according to claim 12, wherein said rearwardly projecting portion of said profile includes upper and lower wall portions converging towards a rearward end of said profile.

15. The desk according to claim 14, further comprising at least one support arm of flat material extending in an orientation along a vertical plane, said support arm extending through at least one slit from inside said profile, wherein said support arm is received between said upper and lower wall portions and rests against at least one rib on the lower wall portion.

16. The desk according to claim 12, further comprising at least one support arm of flat material extending in an orientation along a vertical plane, said support arm extending through at least one slit from inside said profile.

17. The desk according to claim 16, wherein said support arm has an upwardly projecting portion and wherein said panel has a downwardly facing face having a slit, said upwardly projecting portion of said support arm projecting into said slit with a fit preventing tilting of the flat material of said arm out of said orientation along said vertical plane.

18. The desk according to claim 12, wherein between portions of the upwardly projecting portion, the profile is provided with an opening accommodating a power plug socket.

19. The desk according to claim 18, further comprising a lid pivotable between a closed position at least partially closing off said opening and an open position allowing at least more access to said opening than in said closed position, said lid having a thickened portion pivotably received in a slot in said profile having an open side narrower than said thickened portion.

20. The desk according to claim 12, wherein the profile further comprises a slot bounding a chamber and having a forwardly facing open side, the open side being narrower than said chamber.

21. The desk according to claim 12, wherein at least an upper portion of the rearwardly facing edge portion of the panel bordering the at least one opening of the panel is chamfered so as to be leaning obliquely forwardly.

* * * * *